United States Patent [19]

Kostylev et al.

[11] Patent Number: 4,697,647

[45] Date of Patent: Oct. 6, 1987

[54] REVERSIBLE PERCUSSIVE ACTION MACHINE

[75] Inventors: Alexandr D. Kostylev; Vladimir D. Plavskikh; Konstantin B. Skachkov; Alexei D. Terskov, all of Novosibirsk; Igor I. Reznikov; Vladimir I. Tarasenko, both of Odessa, all of U.S.S.R.

[73] Assignee: Institut Gornogo Dela Sibirskogo Otdelenia Akademii Nauk SSSR, Novosibirsk, U.S.S.R.

[21] Appl. No.: 807,587

[22] Filed: Dec. 11, 1985

[30] Foreign Application Priority Data

Feb. 21, 1985 [SU] U.S.S.R. ..... 3851625

[51] Int. Cl.[4] ..... E21B 11/02

[52] U.S. Cl. ..... 173/91; 175/19

[58] Field of Search ..... 173/91, 90; 175/19

[56] References Cited

U.S. PATENT DOCUMENTS 3,891,036 6/1975 Schmidt ..... 173/91

4,078,619 3/1978 Sudnishnikov et al. ..... 173/91

FOREIGN PATENT DOCUMENTS 1170167 11/1969 United Kingdom . .

263482 11/1970 U.S.S.R. .

1118747 10/1984 U.S.S.R. .

*Primary Examiner*—E. R. Kazenske

*Assistant Examiner*—James L. Wolfe

*Attorney, Agent, or Firm*—Fleit, Jacobson, Cohn & Price

[57] ABSTRACT

A reversible percussive action machine includes a housing accommodating a hammer capable of reciprocating motions under the action of a working fluid under pressure, and a valving member with grooves movably connected to the hammer and provided with members for fixing it relative to the housing in two distribution control positions, particularly one that makes the machine move forward and one that ensures the return travel of the machine. The members for fixing the valving member in a position for the forward travel of the machine is fashioned as an insert movable relative to the valving member and having projections received by the grooves of the valving member. The insert is enclosed by a shell with ports, this shell being secured between the housing and the valving member to be capable of axial displacement.

2 Claims, 5 Drawing Figures

REVERSIBLE PERCUSSIVE ACTION MACHINE

BACKGROUND OF THE INVENTION

This invention relates to the art of civil engineering, and more particularly to reversible percussive action machines.

The machine according to the invention can be used for driving holes in the ground during trenchless laying of underground communications.

In addition, the proposed machine can be used as an impact producing unit for driving casings into the ground, sinking piles, and taking soil samples for civil engineering surveying and geological explorations.

An ever increasing use of reversible percussive action machines, particularly for making short-length blind holes to receive cast-in-place piles and for civil engineering and geological surveying, calls for a substantially higher reliability of such devices especially with respect to the reversal mechanism which, along with structural reliability, simplicity and small size, must be sufficiently responsive to, for example, a mere axial pull applied to a flexible hose connected to the machine. These demands account for a range of reversible percussive action machine constructions now being used with varying degree of success.

There is known a reversible percussive action machine (cf., e.g., USSR Inventor's Certificate No. 263,482, IPC E 02 F 5/18, published 1965) which comprises a housing accommodating a hammer capable of reciprocating under the action of a fluid under pressure, and a system for distributing the fliud under pressure to ensure that the hammer delivers impacts on either the front portion of the housing for the forward travel of the machine, or on the rear portion of the housing for the return travel of the machine.

The distribution of the working fluid under pressure in the two operating modes of the machine is controlled by a valving member movably connected to the hammer.

This valving member can be fixed relative to the housing in two positions, particularly front and rear positions; in its front position the valving member controls the distribution of the working fluid to ensure the forward travel of the machine, whereas in the rear position it redistributes the flow of fluid under pressure for the machine to travel backwards.

The valving member is connected to the housing through a tube element affixed to a flange. The flange is rigidly secured inside the housing. Locking of the valving member relative to the housing is done by means of a ball received by a laterally extending hole in the tube and alternately in one of grooves of the valving member in which this ball is held by a spring-loaded nipple having a bevel and a recess and passed through the tube and the interior of the flange. The working fluid under pressure is fed to the nipple by way of a flexible hose connected thereto. The valving member is further spring-loaded relative to the flange.

In order to switch the machine over to the reverse travel operation, it is necessary by applying a tension force to the flexible hose to move the nipple rearwards so that its recess would be opposite the ball. Under the action of a force exerted by the fluid under pressure on the front end face of the valving member the latter tends to move rearwards as far as it goes. Therewith, the ball is forced to the groove of the nipple, and subsequent to releasing the tension applied to the flexible hose it is moved by the nipple bevel to the front recess of the valving member to be locked in position relative to the tube, flange and housing. In this position of the valving member the hammer executes reciprocations inside the housing and delivers impacts on the rear portion thereof for the machine to travel back along the already made hole toward the hole mouth.

For resuming the forward percussive action of the machine it is necessary to terminate the supply of fluid under pressure and pull on the flexible hose. In consequence, the nipple moves rearwards so that the ball assumes a position opposite the nipple groove. The force of the spring of the valving member acts to move the ball to the nipple groove for the valving member to be displaced forward so that its rear recess is opposite the ball. After releasing the pull force on the flexible hose the nipple moves forward under the action of another spring to displace by its bevel the ball to the rear recess of the valving member and fix it in position relative to tube, flange and housing. With this position of the elements and after feeding the fluid under pressure to the machine the hammer resumes its reciprocations and delivers impacts on the front portion of the housing, whereby the machine travels forward.

However, the aforedescribed reversible percussive action machine is inherently unreliable due to possible inadvertent switchovers from the forward to reverse travel operation caused by insufficient urging of the ball by the spring-loaded nipple. It deems impossible to make ball urging more reliable, since it requires the use of a spring of greater force to spring-load the nipple. Accordingly, this spring force must not be greater than a tension force manually applied to the flexible hose connected to the nipple during switching machine operation from the forward to the reverse travel.

In addition, the above machine features a rather low reliability due to insufficient service life of its parts caused by high contact stressed in the ball and cooperating parts of the valving member, nipple and tube, since the ball is capable of only a point contact therewith.

The machine is further characterized by a relatively low specific power (power per unit area of machine crosssection), since the use of the ball entails an increase in machine diameter.

There is also known a reversible percussive action machine (cf., USSR Inventor's Certificate No. 1,118,747; IPC E 02 F 5/18, published 1980) comprising a housing accommodating a hammer reciprocating under the action of a working fluid under pressure and delivering impacts on the front portion of the housing during the forward travel and on the rear portion during the return travel of the machine, and a valving member for controlling the distribution of the working fluid under pressure movably connected to the hammer and provided with means for fixing it relative to the housing in two positions for the forward travel and the reverse travel of the machine, respectively.

The valving member is connected to the housing through a resilient plate secured on this member and a flange rigidly affixed to the housing. The resilient plate has a projection to cooperate with the flange, and a beveled lug to engage with a bevel of a sleeve provided at the other end thereof with a flexible hose for feeding the working fluid under pressure. The valving member further has a stop and is spring-loaded relative to the flange; whereas the flange has a groove to receive the lug of the resilient plate, the flange having a recess to receive the projection of the resilient plate.

When the machine operates n the forward travel percussive action mode, the lug of the flexible plate occupies the recess of the flange to lock the valving member in the frontmost position relative to the housing. Subsequent to feeding the working fluid under pressure the hammer reciprocates inside the housing and delivers impacts on the front portion thereof, whereby the machine moves forward in the ground leaving a hole behind.

In order to switch the machine over to the reverse percussive action mode of operation, it is necessary to pull on the flexible hose and thus move the sleeve rearwards. The sleeve bevel transmits a radial force to the beveled lug of the flexible plate. Under the action of this force the resilient plate is caused to enter the groove, and the projection of the flexible plate is brought out of engagement with the recess of the flange. The pressure of the working fluid makes the valving member move rearwards until the stop of the valving member is in engagement with the flange. In this position the valving member ensures reciprocations of the hammer in the housing of the machine accompanied by the delivery of impacts on the rear portion of the housing, whereby the machine moves along the hole backwards to the hole mouth, i.e., the percussive action of the machine is reversed.

For resuming the forward travel of the machine the supply of the working fluid under pressure is terminated. The spring loading the valving member relative to the flange acts to move the valving member to its front position corresponding to the forward percussive action of the machine (the lug of the flexible plate enters the recess of the flange and locks the valving member relative to the housing in the frontmost position), whereby subsequent to feeding the fluid under pressure the hammer resumes its reciprocations to deliver impacts on the front portion of the housing and the machine functions in the forward percussive action mode of operation.

One disadvantage of the aforedescribed machine is that it is not sufficiently reliable in operation, since arbitrary switchover from the forward to the reverse percussive action is possible by accidentally applying a pull force to the flexible hose.

In addition, low reliability may be caused by the possible damage of the resilient plate under the action of axial forces exerted thereon by the valving member and produced by the fluid under pressure in the working chambers of the machine. The resilient plate is also susceptible to damage due to the action of bending forces exerted thereon by the lug when it cooperates with the flange.

SUMMARY OF INVENTION

It is the principle object of this invention to provide reliable means for fixing a valving member in its working positions in a reversible percussive action machine.

Another object is to ensure that the means for fixing the valving member is structurally simplified.

One more object is to provide a reversible percussive action machine which would be easy to operate and simple to manufacture.

These and other objects and attending advantages are attained by that in a reversible percussive action machine comprising a housing accommodating a hammer capable of reciprocating motions inside the housing under the action of a working fluid under pressure to deliver impacts on a front portion of the housing during the forward travel of the machine and on the rear portion of the housing during the reverse travel, and a valving member having grooves to control the distribution of the working fluid under pressure movably connected to the hammer and provided with a means for fixing it relative to the housing in two fluid distribution control positions, particularly one for the forward and one for the reverse travel of the machine, the means for fixing the valving member in the forward operation mode of the machine having the form of at least one springloaded insert having projections and movable relative to the valving member, according to the invention, the projections of the insert are received by the grooves of the valving member, whereas the insert is embraced by a shell having ports arranged between the housing and valving member for axial displacements.

Preferably, the shell is cylindrical in configuration.

The aforedescribed structural modifications provide a reversible percussive action machine which is more reliable in operation due to more dependable locking of its valving member in extreme positions relative to the housing.

The provision in the insert of projections cooperating with grooves of the valving member and those of the housing makes it possible to reliably lock the valving member during operation of the machine in the forward percussive action mode. Inadvertent application of tension to the flexible hose does not cause disengagement of the insert from the housing, because the force produced by the working fluid under pressure is transmitted axially to the valving member the grooves of which transmit a radial force to the projections of the insert to continuously fix it (and the valving member) in position relative to the housing. it is to be noted that by varying the inclination angle of the bevels of the insert projections it is possible to adjust the pull force required for reversing the percussive action of the machine. The same effect can be attained by varying the inclincation angle of the bevels of the housing and insert.

Embracing the insert by a shell capable of axial displacements makes it possible to dispense with a rigid connection of the insert to the valving member thus preventing damage of the insert at the point where it is connected to the valving member under the action of impact loads. In addition, such an arrangement of the insert and valving member obviates the effect of tensile and being stresses, since the insert serves merely as a spacer or slide block between the valving member and the housing and is therefore subjected to exclusively compression forces, thus adding to the overall reliability of the machine.

The proposed machine is more reliable in operation also due to the fact that the insert may be displaced in the shell port so that the rear projection thereof is received by the front groove of the valving member, whereas the front projection accommodates in the rear groove. The locking of the insert in a position for the reverse percussive action likewise enhances its reliability.

In view of the aforedescribed, the proposed reversible percussive action machine ensures longer service life of parts, more reliable locking of the valving member, and higher dependability of the machine in operation.

BRIEF DESCRIPTION OF THE DRAWINGS

The invention will now be described in greater detail with reference to various specific embodiments thereof taken in conjunction with the accompanying drawings, in which.

DESCRIPTION OF THE PREFERRED EMBODIMENTS

Figure 1:
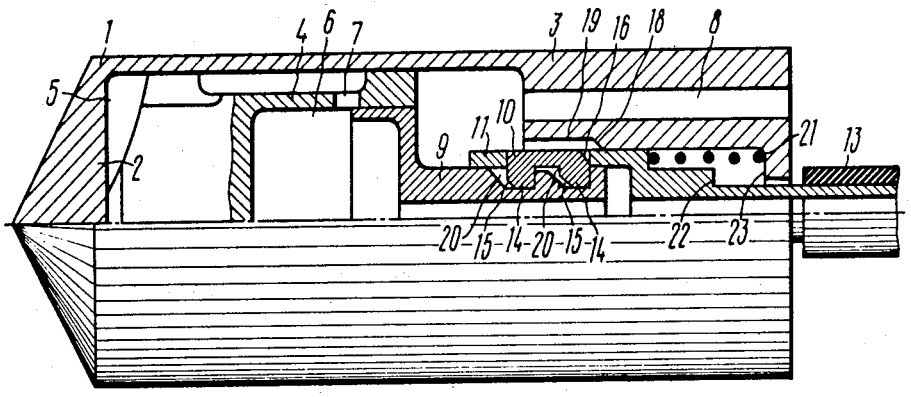
FIG. 1 shows a partial longitudinal sectional view of a reversible percussive action machine in a position prior to feeding a working fluid under pressure thereto.

A reversible percussive action machine with reference to FIG. 1 comprises a hollow housing 1 having a headpiece or front portion 2 and a tailpiece or rear portion 3 to take up impacts delivered by a hammer 4 secured inside the housing 1 for reciprocations in response to the action of a working fluid under pressure. During the forward travel of the machine the hammer 4 delivers impacts on the front portion 2 of the housing 1. During the reverse travel of the machine the hammer 4 delivers impacts on the rear portion of the housing 1. The machine also comprises a system for distributing the fluid under pressure both during the forward and reverse travel. This system includes a front working chamber 5 defined by the inner surface of the housing 1 and the outer surface of the hammer 4, and a rear working chamber 6 defined by the interior of the hammer 4. The system also includes passages 7 to communicate the front and rear working chambers 5 and 6, respectively, and pasages 8 provided in the housing 1 to discharge the fluid outside. The machine further comprises a valving member 9 movably connected by one end to the hammer 4. The valving member 9 can assume two positions relative to the housing 1. In one position (the front position) the valving member 9 controls the distribution of fluid under pressure for the forward travel of the machine, whereas in the other (the rear position) it controls the fluid distribution for the reverse travel of the machine.

Figure 5:
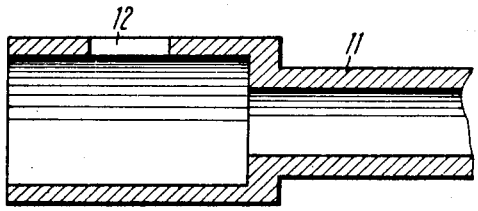
FIG. 5 is a sectional view of a shell with a port.

The valving member 9 is provided with a means for fixing it in a position ensuring the forward travel of the percussive action machine. This means has the form of an insert 10 (FIGS. 1 to 4) movable relative to the valving member 9. The insert 10 (FIG. 2) engages with the housing 1 thus axially fixing the valving member 9 relative to the housing 1 to assure the forward travel of the machine. In the position for the reverse travel of the machine the insert 10 (FIG. 3) ensures the mobility of the valving member 9 relative to the housing 1 when the machine is switched over to the reverse travel. Secured at the other end of the valving member 9 is a cylindrical shell 11 ports 12 (FIG. 5) of which accommodate the insert 10. The opposite end of the shell 11 is connected to a source (not shown) of the working fluid under pressure via a flexible hose 13 which is secured by one of its ends to the end of the shell 11 and by the other end to the source of the working fluid under pressure.

The insert 10 has the form of a plate with projections 14 having bevels 15.

Engagement of the insert 10 with the housing 1 for fixing axially the valving member 9 relative to the housing 1 during the forward travel of the percussive action machine is ensured by a bevel 16 of the insert 10, surface 17 of the insert 10, bevel 18 of the housing 1 and surface 19 of the housing 1, as well as by grooves 20 of the valving member 9.

The proposed percussive action machine further has a spring 21 urging the housing 1 axially and providing the displacement of the shell 11 of the valving member 9 to the front position and locking it for the forward travel operation of the machine. The shell 11 has a shoulder 22 intended to limit the axial displacement of the valving member 9 through cooperation with an inverted shoulder 23 of the housing 1.

The reversible percussive action machine represented in FIGS. 1 to 4 features one insert, although the number of such inserts may be more than one to ensure highly reliable operation of the machine.

The machine according to the invention operates in the following manner.

The machine is shown in its initial position with no fluid under pressure fed thereto. When the fluid is delivered to the machine through the flexible hose 13 connected to the shell 11, it flows through the central passages of the shell 11 and valving member 9 to the rear working chamber 6 and along the passage 7 to the front working chamber 5 to exert pressure on the front end face of the valving member 9, whereby it is displaced backwards to the rear portion 3 of the housing 1. The grooves 20 of the valving member 9 are brought into engagement with the bevels 15 of the projections 14 of the insert 10 to move it along the ports 12 of the shell 11 radially until the surface 17 of the insert 10 is thrust against the surface 19 of the housing 1. This causes the insert 10 with the valving member 9 and shell 11 to move backwards to the rear portion 3 of the housing 1, whereby the bevel 16 of the insert 10 and the bevel 18 of the housing 1 cooperate to fix the valving member 9 relative to the housing 1. The force of the spring 21 is such that is fails to prevent the movement of the shell 11 relative to the housing 1 and therefore the spring 21 is compressed but a little.

Figure 2:
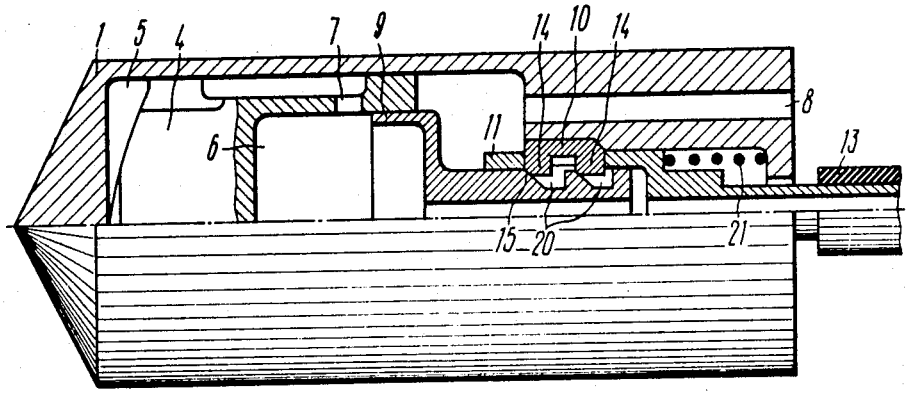
FIG. 2 is a partial longitudinal sectional view of the reversible percussive action machine shown in FIG. 1 in a position for the forward travel.

The new position of the machine elements subsequent to feeding thereto a working fluid under pressure is represented in FIG. 2 and corresponds to the forward travel operation of the machine.

In the forward travel mode of operation the pressure of fluid occupying the front and rear working chambers 5 and 6, respectively, acts to make the hammer 4 reciprocate and deliver impacts on the front portion 2 of the housing 1. Under these impacts the machine moves forward in the ground and leaves a hole behind. The fluid under pressure enters the working chamber 5 through the passage 7, and is discharged therefrom along the passage 7 and passage 8 of the housing 1.

Figure 3:
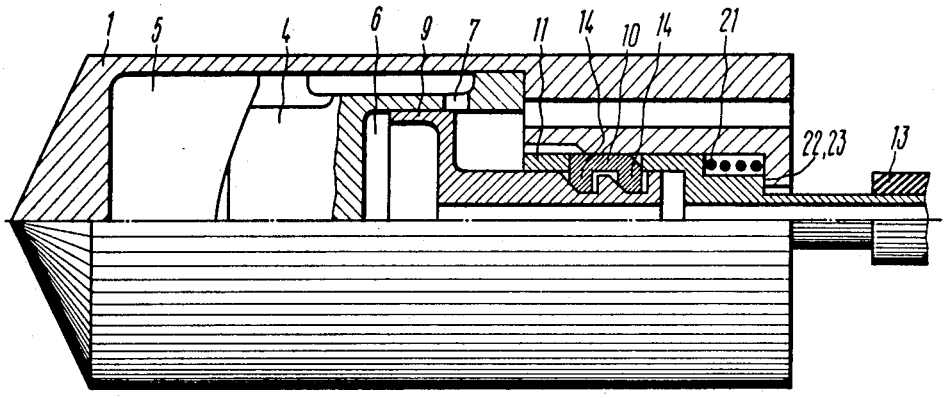
FIG. 3 is a partial longitudinal sectional view of the reversible percussive action machine shown in FIG. 1 in a position for the reverse travel.
Figure 4:
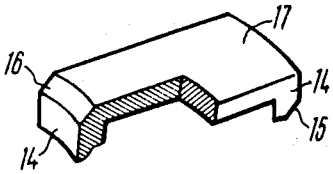
FIG. 4 is an isometric view of an insert.

For reversing the percussive action of the machine (i.e., for switching the machine over to the return travel mode of operation) it is necessary to cut off the supply of the working fluid under pressure and thereafter pull on the flexible hose 13 with a force greater than the force of the spring 21. In consequence, the insert 10 slides by its bevel 16 on the bevel 18 of the housing 1 to move radially in the port 12 of the shell 11 for the projections 14 of the insert 10 to be received by the grooves 20 of the valving member 9. Thereafter, the insert 10 with the shell 11 and valving member 9 moves backwards (toward the rear portion 3 of the housing 1) until the shoulder 22 of the shell 1 and the shoulder 23 of the housing 1 are brought into engagement, whereby the spring 21 is compressed. The new position of the elements as represented in FIG. 3 correspond to the return travel of the machine.

Now without releasing the tension from the flexible house 13 it is necessary to feed the working fluid under pressure to the working chambers 5 and 6 of the machine and then slacken the pull on the hose 13. The action of the working fluid under pressure in the chambers 5 and 6 causes the valving member 9 to be fixed relative to the housing 1 in a new position, whereby the hammer 4 to executes reciprocations inside the housing 1.

Thanks to the valving member 9 having assumed this new position offset axially toward the rear portion 3 of the housing 1, the working fluid under pressure tends to flow through the passage 7 and occupy the working chamber 5 earlier in time, and the discharge of the fluid from the working chamber 5 through the passages 7 and 8 occurs later in time, whereby the hammer 4 delivers impacts on the rear portion 3 of the housing 1.

Under the action of the impacts the housing 1 and the machine move back along the already made hole to the hole mouth.

A repeated switchover of the machine to the forward percussive action follows automatically after terminating the delivery of the working fluid under pressure thereto. Accordingly, the spring 21 acts to move the valving member 9 to the front position, as best seen in FIG. 1. When the working fluid under pressure is again fed to the machine in the aforedescribed manner, the elements of the machine assume the position represented in FIG. 2 and the machine starts its forward action to move down the hole.

What is claimed is:

1. A reversible percussive action machine comprising:

a housing;

a hammer accommodated inside said housing for executing reciprocating motions under the action of a working fluid under pressure;

a system for distributing said working fluid under pressure to reciprocate said hammer and deliver impacts on a front portion of said housing for forward travel of the machine and to deliver impacts on a rear portion of said housing for reverse travel thereof;

a valving member of said system for distributing the working fluid arranged in said housing, said valving member being movably mounted on said hammer;

means for fixing said valving member in two positions relative to said housing, particularly, one position for the forward travel of the machine and one position for the reverse travel of the machine, said means for fixing the valving member including at least one insert having projections;

said valving member having on a side surface grooves with slanted surfaces for cooperation with said projections of said insert;

a shell with ports, said insert being located in each of said ports and said shell being secured between said housing and said valving member;

said insert being movable radially with respect to said shell and siad insert being movable radially and axially with rspect to said valving member, said insert cooperating with said grooves of said valving member by said projectiosn which slant corresponding to the slanted surfaces of said grooves, and a spring in said housing for axially urging said housig relative to said valving member.

2. A reversible percussive action machine as defined in claim 1, in which said shell is cylindrical.

* * * * *